US009408501B2

(12) United States Patent
Erlebach

(10) Patent No.: US 9,408,501 B2
(45) Date of Patent: Aug. 9, 2016

(54) SHOWER STALL CURB COVER

(71) Applicant: Josef Erlebach, Silverthorne, CO (US)

(72) Inventor: Josef Erlebach, Silverthorne, CO (US)

( * ) Notice: Subject to any disclaimer, the term of this patent is extended or adjusted under 35 U.S.C. 154(b) by 233 days.

(21) Appl. No.: 14/486,427

(22) Filed: Sep. 15, 2014

(65) Prior Publication Data

US 2015/0074898 A1 Mar. 19, 2015

Related U.S. Application Data

(60) Provisional application No. 61/879,234, filed on Sep. 18, 2013.

(51) Int. Cl.

| | |
|---|---|
| ***A47K 3/00*** | (2006.01) |
| ***B21D 39/03*** | (2006.01) |
| ***A47K 3/40*** | (2006.01) |

(52) U.S. Cl.

CPC ..... *A47K 3/40* (2013.01); *Y10T 29/49826* (2015.01)

(58) Field of Classification Search

CPC ..... A47K 3/40
USPC ..... 4/612–614
See application file for complete search history.

(56) References Cited

U.S. PATENT DOCUMENTS 6,006,375 A * 12/1999 Carr ..... A47K 3/40 4/609
2010/0071125 A1* 3/2010 Miller ..... A47K 3/40 4/613

* cited by examiner

*Primary Examiner* — Huyen Le
*Assistant Examiner* — Christine Skubinna
(74) *Attorney, Agent, or Firm* — Leyendecker & Lemire LLC

(57) ABSTRACT

A three dimensional structure comprised of a flexible sheet material referred to herein as a curb cover is described that can be easily secured with adhesive or resin over the intersection of a shower stall floor, a shower stall wall, and a step over curb. The curb cover is used in conjunction with a waterproof membrane to waterproof the shower pan and up portions of the surrounding wall and step over curb.

20 Claims, 7 Drawing Sheets

SHOWER STALL CURB COVER

RELATED APPLICATIONS

The present application claims priority to and incorporates fully by reference U.S. Provisional Application No. 61/879,234, filed on Sep. 18, 2013, which has the same title and inventor as the present application.

BACKGROUND

A typical tiled shower stall floor comprises a shower pan formed over a sub-floor that includes an upper surface that slopes towards a shower drain. The pan is typically formed from a dry-set concrete material, but in some installations preformed and pre-sloped slabs of a suitable material may be used. A waterproofing is typically applied to the top surface of the pan extending several inches up the sides of the walls of the shower stall surrounding the pan. Often the form of the waterproofing comprises a waterproof membrane that is adhesively bonded to the pan.

All or part of one side of the stall usually includes an opening to allow egress and ingress to the stall. A curb approximately 3-6" in height is often provided at the base of the opening to prevent water from flowing from the shower floor on to the rest of the floor of the associated bathroom. The membrane is also secured to at least the inside edge of the curb and often over the entire surface of the curb. A shower door may be installed above the curb to cover the opening.

The desired tile is installed over the membrane usually using traditional methods of applying mortar over the waterproofing and setting the tiles in place. Finally, as necessary the gaps between the tiles are grouted. In some installations, the tiles may further extend up the shower stall walls. Tiles are typically utilized to cover at least the inside and top surfaces of the curb if not the entire curb.

The laying and securing of the waterproof membrane to the substantially flat albeit sloped surface of the shower pan is straight forward as is extending the sheet on to and partially up a shower wall. More care and time is required in adjoining pieces of membrane where two walls meet, such as where the edge of a curb meets an adjacent wall. The edges of the membrane associated with each wall must be cut so as to overlap and one piece must be adhesively secured to the other. Further, membrane must be configured to extend over and around the intersection of the curb with adjoining walls. As can be appreciated significant amounts of installation time can be required to cut, fabricate and bond membrane in place that effectively water proofs the various underlying surfaces immediately surrounding and abutting the intersection.

EMBODIMENTS OF A WATERPROOF MEMBRANE CURB COVER

Figure 1:
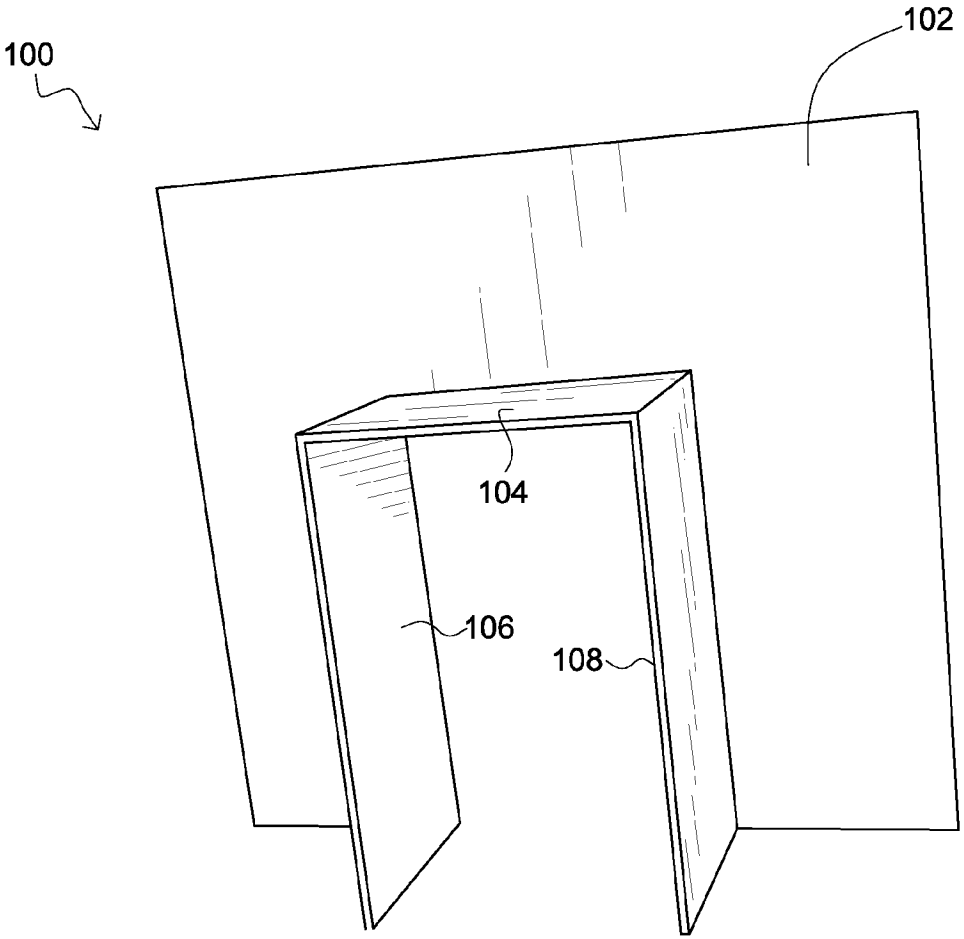
FIG. 1 is a front perspective view of a curb cover according to one embodiment of the present invention.

A three dimensional flexible structure comprised of a sheet material referred to herein as a curb cover is described that can be easily secured with adhesive or resin over the intersection of a waterproof membrane at a shower stall floor, a shower stall wall, and a step over curb. The use of the curb cover obviates the need to overlap sections and portions of the waterproof membrane in the corner and/or cut additional pieces of waterproof membrane sheet to bridge corners and overlap edges of the waterproof membrane to ensure water tightness at the intersections of the referenced shower stall structures.

Simply, to fully waterproof and seal the underlying shower stall structures, the waterproof membrane sheet is cut in such a manner as to abut or nearly abut the intersection of the curb with the adjacent shower wall. A suitable adhesive is applied to the backsides of the curb cover and the cover is pressed against and over the waterproof membrane at the intersection.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

The terms "removable", "removably coupled", "removably installed," "readily removable", "readily detachable", "detachably coupled", "separable," "separably coupled," and similar terms, as used in this specification and appended claims, refer to structures that can be uncoupled, detached, uninstalled, or removed from an adjoining structure with relative ease (i.e., non-destructively, and without a complicated or time-consuming process), and that can also be readily reinstalled, reattached, or coupled to the previously adjoining structure.

Directional or relational terms such as "top," bottom," "front," "back," "above," "beneath," and "below," as used in this specification and appended claims, refer to relative positions of identified elements, components, or objects, where the components or objects are oriented in an upright position as normally installed or used.

Embodiments of a Curb Cover

Figure 2:
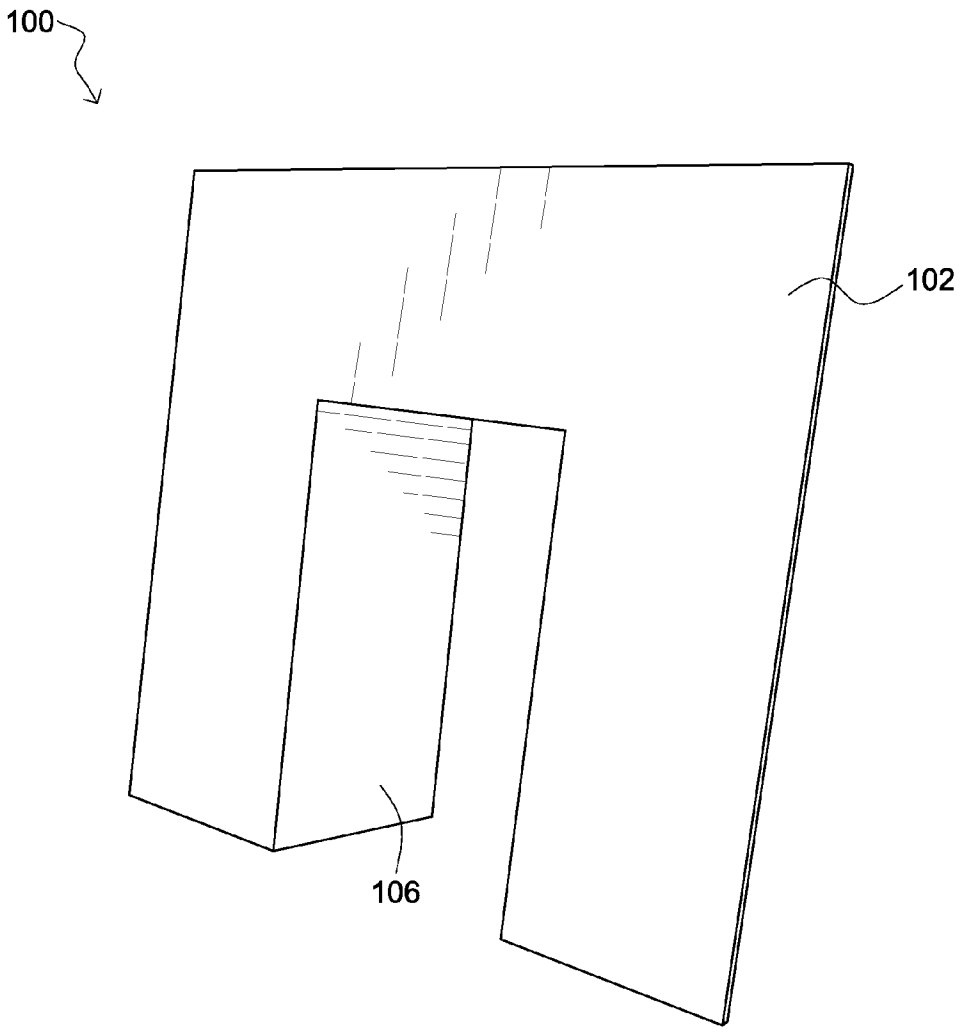
FIG. 2 is a back side perspective view of the curb cover according to one embodiment of the present invention.
Figure 3:
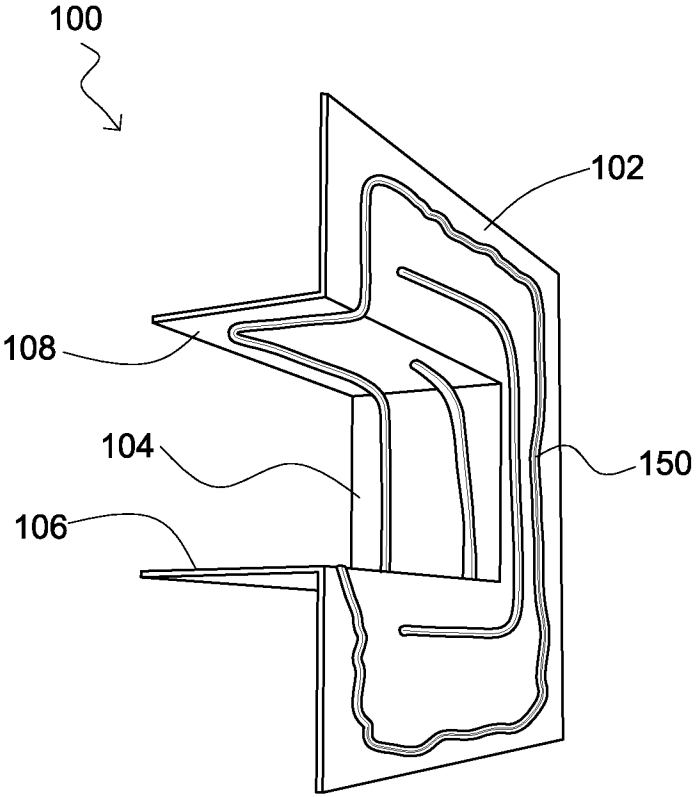
FIG. 3 is a back side perspective view of the curb cover from another angle showing adhesive beads thereon according to one embodiment of the present invention.
Figure 4:
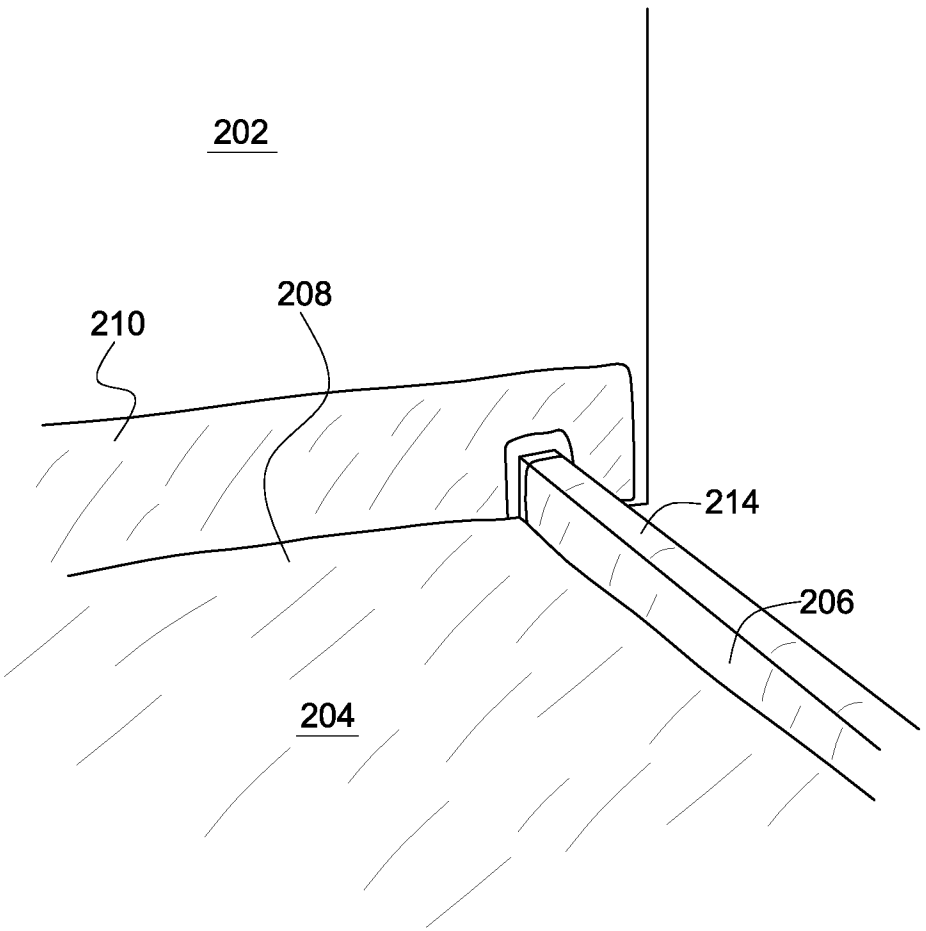
FIG. 4 is a partial perspective view of a shower stall having an entry curb under construction after laying a shower pan and waterproof floor membrane but prior to the installation of the final flooring according to one embodiment of the present invention.
Figure 5:
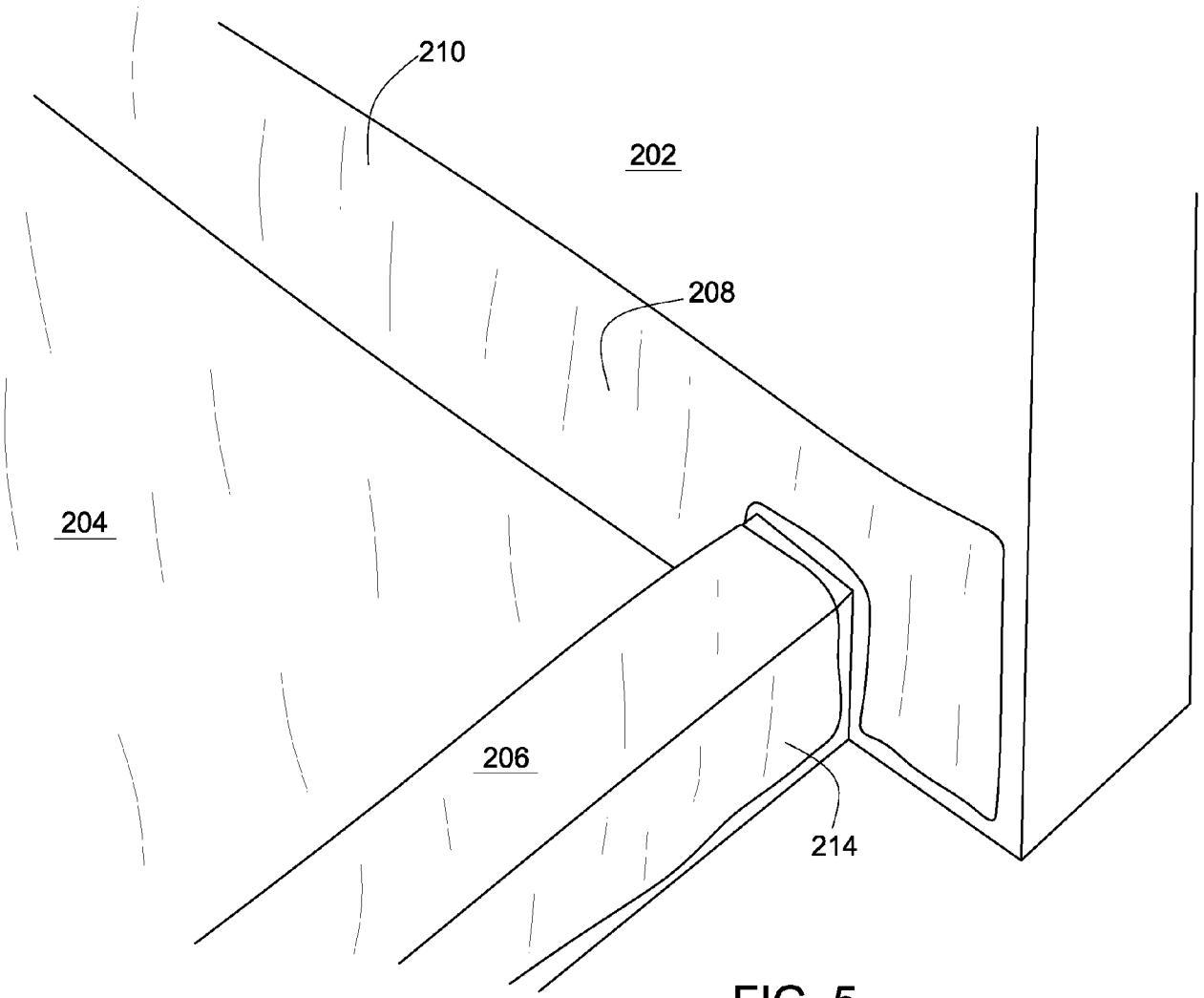
FIG. 5 is also a partial perspective view from another angle of a shower stall having an entry curb under construction after laying a shower pan and waterproof floor membrane but prior to the installation of the final flooring according to one embodiment of the present invention.

As illustrated in FIGS. 1-3, embodiments of the present invention comprise a formed three dimensional curb cover 100 typically comprised of waterproof membrane. The membrane can comprise any suitable flexible water impervious sheet material. One type of material comprises a thermoplastic layer of chlorinated polyethylene having non-woven polyester fabric or scrim laminated to both opposing sides. The forgoing material is similar to Nobleseal® TS made by the Noble Company of Grand Haven, Mich. In other variations the sheet material may comprise a polyethylene (or another polymeric material) without woven or non-woven fabric lamination.

In at least one other embodiment, the curb cover is made solely of a non-woven fabric with fibers comprised of a suitable thermoplastic, such as but not limited to, polyester. The thermoplastic fibers permit the cover made of this material to be heat formed in a similar manner as described herein for a waterproof variation. This variation is not waterproof and is typically utilized in conjunction with a similar non-woven fabric sheet material. Once the shower pan and the surrounding walls are covered with the pervious non-woven material, a liquid resin is applied thereto, wetting the fibers and upon curing forming a waterproof layer or membrane in situ that is also well bonded to the underlying substrate. The configuration of the non-woven fabric curb cover is substantially identical to the cover illustrated in FIGS. 1-3 except adhesive beads or fillets as shown in FIG. 3 would not be used during the installation of this embodiment.

The three dimensional structure is formed by any suitable means. In one embodiment, the curb cover 100 is thermoformed from a single sheet using appropriate tooling. Upon heating, stretching with suitable tooling and cooling, the resulting cover maintains the provided shape and is imperviously to water penetration. In other variations, multiple pieces of sheet material can be utilized that are cut, overlapped and bonded/fused together to form the curb cover structure.

Figure 7:
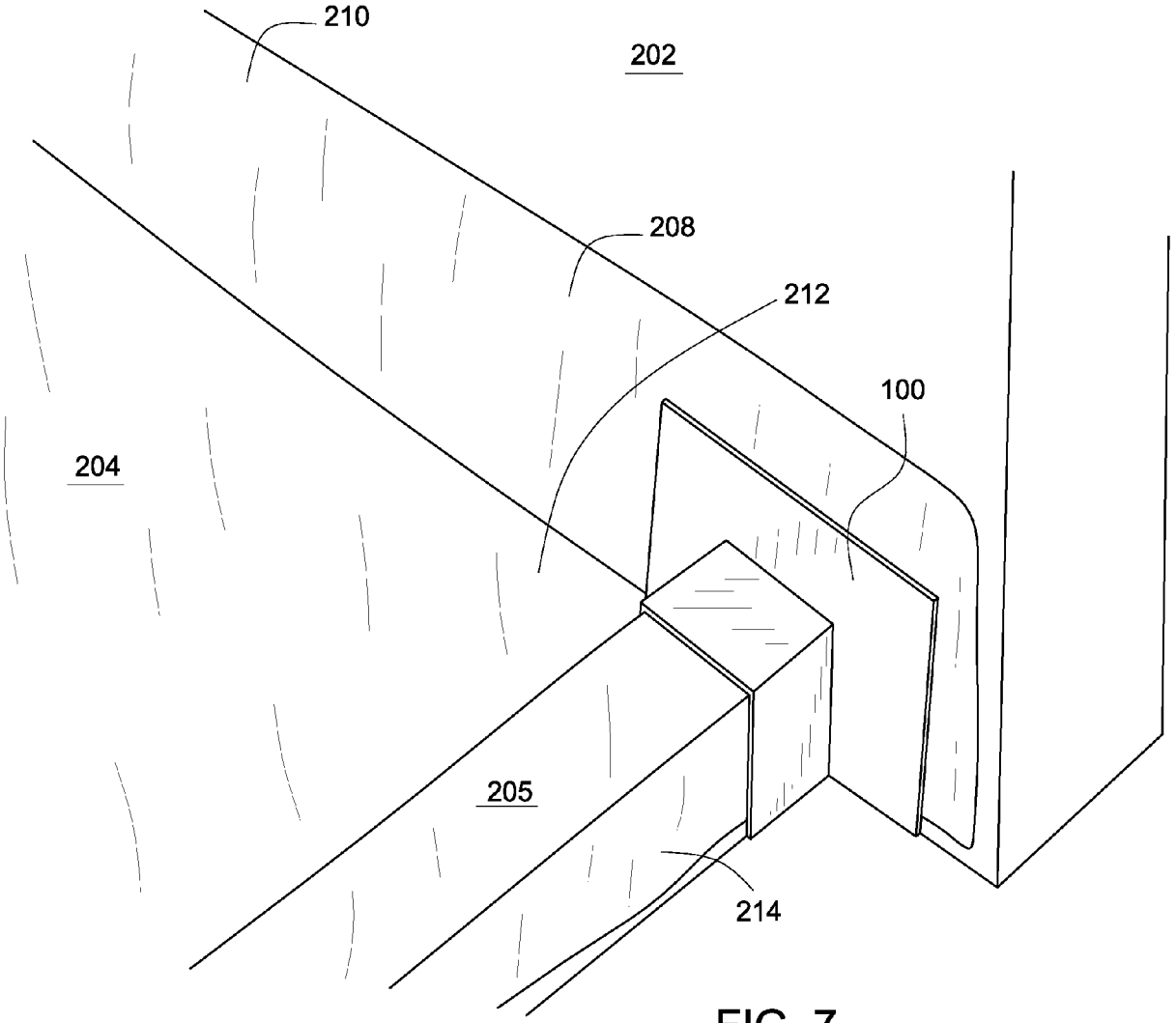
FIG. 7 is also a partial perspective view from another angle of a shower stall having an entry curb under construction after laying a shower pan and waterproof floor membrane with curb cover installed but prior to the installation of the final flooring according to one embodiment of the present invention.

With reference to FIGS. 1-3, the curb cover 100 comprises four planar sections, each section having a backside that is placed directly against the shower stall structures and the waterproof membrane sheet covering them, and a front side that faces outwardly and typically receives the final shower stall floor covering, often tile, there over. The shower wall abutting section 102 in the shape of an inverted-U and is configured to fit around the curb where it intersects with and bonds flush against the shower wall 202 (as seen, for instance, in FIG. 7). The three remaining sections, namely top, left and right side curb abutting sections 104-108, extend orthogonally outwardly from interior edges of the shower wall abutting section and are configured to mate and bond flush against the respective top, left and right sides of the curb 206 (as also seen in FIG. 7). On installation, the curb cover overlaps waterproof membrane 208 on the wall and the three sides of the curb to provide a waterproof intersection.

In another variation, the curb cover can be installed first directly against the curb surfaces and the adjoining wall with the waterproof membrane being installed over it.

Installation of an Embodiment of a Waterproof Membrane Curb Cover

With reference to FIGS. 4-7, the installation of an embodiment of the curb cover is described herein. A representation of a portion of a shower stall having a curb 206 is shown from two different angles in FIGS. 4 and 5. The typical rectangular stall comprises three floor to ceiling walls 202 and an open side, which may or may not include a shower door. The open side includes a curb 206 that spans between two walls and is most often a few inches tall. Its primary purpose is to prevent any water that may pool on the stall floor 204 from flowing into the bathroom. The intersection of the curb 206 with one wall 202 is shown in the Figures. It is to be appreciated that a similar opposing intersection also exists at the other end of the curb.

In the construction of a shower stall, a shower pan (not shown) is typically laid over the subflooring. The pan can be formed in place using a dry set concrete to properly slope the pan towards a shower drain. In other instances, preformed sloped panels can be installed over the subfloor. Sloped panels are often more convenient to use and can be more quickly installed than the use of dry set concrete; however, because they only slope in a single direction they are best suited to use in conjunction with elongated drains such as those described in U.S. Pat. No. 8,239,974 and published U.S. Patent Application 20110061161, both having the same inventor as the present application and being incorporated herein by reference.

Once the shower pan has been secured in place and as applicable has cured, a waterproof membrane 208 is adhesively secured to the pan 204 to inhibit and prevent the penetration of water into the pan and the underlying subfloor. Another portion 210 of the membrane is typically folded and continued several inches up the sides of the surrounding walls. To facilitate this, the membrane is cut and slit as necessary. For instance, in the intersecting corners of orthogonal walls, the membrane is slit, the excess from one wall is folded over the membrane on the other wall, and the overlapped portion is adhesively bonded in place to create a water tight corner.

Concerning curbs, the membrane is typically extended up and over the curb and down the backside as best shown in the Figures creating a curb portion 214. The wall portion 210 of the membrane at the location of the curb's termination is typically cut away at the intersection and continues several inches past the intersection. If tiled as shown, water could pool at the corner formed by the inside surface of the curb where it intersects with both the wall 202 and the shower pan 204 and seep past the tile at a grout line and into the subfloor and/or the wall.

Using prior art methods, the cut away portion on the wall would have been cut only on two sides and the flap would have been folded over against the inside surface of the curb. To ensure water tightness, additional pieces of membrane would have been bonded to the wall and curb portions 210 & 214. The entire prior art process is time consuming with the particular configuration of additional pieces depending on the peculiarities of the installer.

Installation of the curb cover 100 over the curb 206 and wall 202 intersection is relatively simple. As shown in FIG. 3, an adhesive bead is applied to the backsides of the curb cover. Ideally, the beads of adhesive are arranged and overlapped to ensure a complete watertight seal with the underlying membrane when installed and fully pressed against the respective underlying surfaces.

After the application of the adhesive bead, the cover 100 is simply lowered into place at the intersection wherein it is positioned. A spatula, or other suitable similar implement, can be used to fully press the corners of the cover into the corners of the wall/curb intersections. A roller, spatula or squeegee can be used to further press the side surfaces of the cover into the underlying surfaces and spread the adhesive/sealant to create a complete seal.

Figure 6:
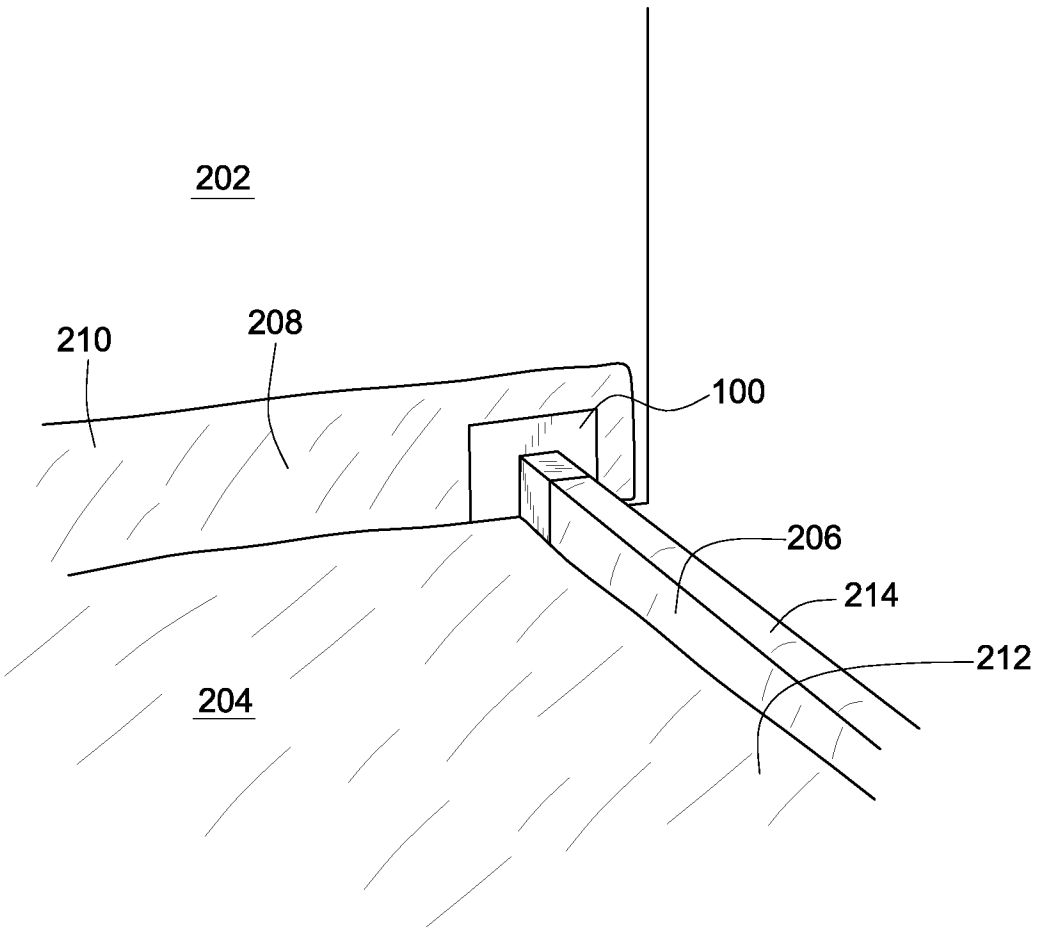
FIG. 6 is a partial perspective view of a shower stall having an entry curb under construction after laying a shower pan and waterproof floor membrane with curb cover installed but prior to the installation of the final flooring according to one embodiment of the present invention.

FIGS. 6 & 7 show the curb cover 100 installed over the underlying membrane to create a fully watertight intersection between the curb 206 and the wall 202. The entire process can be completed in a fraction of the time that would be required to fit and overlap various pieces of membrane to create the necessary seal using prior art methods.

As can be appreciated in at least one variation to the methodology described herein, the curb cover can be installed directly against the surfaces of the curb and the adjoining wall with the waterproof membrane being adhesively bonded over the curb cover.

After sufficient time is provided to allow the adhesive to harden and/or cure, tiles or other flooring can be applied to complete the shower stall.

Installation of an Embodiment of a Non-Woven Fabric Curb Cover

The shower pan is constructed in substantially the same manner as described above. A non-woven sheet material is cut as necessary to fit the particular shower enclosure. In some variations, the sheet material can be dry fit prior to applying a liquid resin. In other applications, the sheet material can be cut to size as it is permanently installed.

Once the shower pan has cured sufficiently, the suitable liquid resin is prepared and applied to the surfaces of the pan and the surrounding walls and curb. The non-woven sheet material is then pressed into the resin, which wets the fibers of the non-woven fabric. Rollers and other tools can be used to work the fabric into place and fully wet it out. As necessary to fully impregnate the fabric material, additional resin may be poured on to the top of the fabric at strategic locations.

To affix the curb cover, additional resin is applied to the area of the shower stall in which the cover is to be received. The curb cover is then laid and pressed in place. The cover is worked with rollers, squeegees and other suitable tools to fully wet out the fabric's fibers and ensure complete coverage. As necessary, additional resin may be added to the exposed surfaces of the cover.

In one variation, the curb cover can be applied to the curb and wall intersection first and wet out with the resin and the non-woven sheet material can be applied to the pan and over the curb cover thereafter.

After sufficient time is provided to allow the resin to harden and/or cure, tiles or other flooring can be applied to complete the shower stall.

Other Variations and Embodiments

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A one piece curb cover, the cover comprising a single piece of flexible sheet material having: (1) a substantially vertically orientated, inverted u-shaped planar portion defining opposing substantially left and right vertical interior edges and defining a substantially horizontal interior top edge spanning between the ends of the vertical interior edges; (2) a left substantially vertical planar portion extending orthogonally outwardly from the u-shaped planar portion along the left vertical interior edge; (3) a right substantially vertical planar portion extending orthogonally outwardly from the u-shaped planar portion along the right vertical interior edge; and (4) a top substantially horizontal planar portion extending orthogonally outwardly from the u-shaped planar portion along the horizontal interior top edge, the top substantially horizontal planar portion orthogonally intersecting with the right substantially vertical planar portions at a right end and the top substantially horizontal planar portion orthogonally intersecting with the right substantially vertical planar portions at a left end.

2. The curb cover of claim 1, wherein the flexible sheet material comprises a non-woven fabric.

3. The curb cover of claim 2, wherein the non-woven fabric comprises polyester fibers.

4. The curb cover of claim 1, wherein the flexible sheet material comprises a thermoplastic polymeric sheet.

5. The curb cover of claim 1, wherein the flexible sheet material comprises a thermoplastic polymeric sheet having a fabric adhered to both front and back surfaces.

6. The curb cover of claim 5, wherein the fabric is non-woven.

7. The curb cover of claim 1, wherein the curb cover is thermoformed.

8. A shower stall, the shower stall including:

a shower pan;

a left wall;

a right wall;

a back wall;

a rectangular curb having top, left and right sides;

a waterproof membrane; and first and second waterproof curb covers, each curb cover comprising a single piece of flexible sheet material having (a) a substantially vertically orientated, inverted u-shaped planar portion defining opposing substantially left and right vertical interior edges and defining a substantially horizontal interior top edge spanning between the ends of the vertical interior edges, (b) a left substantially vertical planar portion extending orthogonally outwardly from the u-shaped planar portion along the left vertical interior edge, (c) a right substantially vertical planar portion extending orthogonally outwardly from the u-shaped planar portion along the right vertical interior edge, and (d) a top substantially horizontal planar portion extending orthogonally outwardly from the u-shaped planar portion along the horizontal interior top edge, the top substantially horizontal planar portion orthogonally intersecting with the right substantially vertical planar portions at a right end and the top substantially horizontal planar portion orthogonally intersecting with the right substantially vertical planar portions at a left end;

wherein (1) the shower pan is bounded (i) on the left by the left wall, (ii) on the right by the right wall, (iii) on the back by the back wall, and (iv) on the front by the rectangular curb extending orthogonally between the left and right walls proximate a front edge of each, (2) the waterproof membrane covers and is bonded to substantially the entire shower pan, the rectangular curb and a portion of the left, right and back walls proximate an intersection with the shower pan, (3) the first waterproof curb cover covers portions of top, left and right sides of the rectangular curb and the left wall waterproof membrane proximate an intersection of the left wall with the rectangular curb, and (4) the second waterproof curb cover covers portions of top, left and right sides of the rectangular curb and the right wall proximate an intersection of the right wall with the rectangular curb.

9. The shower stall of claim 8, wherein the curb cover of claim 1, wherein the flexible sheet material comprises a non-woven fabric.

10. The shower stall of claim 8, wherein the non-woven fabric comprises polyester fibers.

11. The shower stall of claim 8, wherein the flexible sheet material comprises a thermoplastic polymeric sheet having a fabric adhered to both front and back surfaces.

12. The shower stall of claim 8, wherein the waterproof membrane and the first and second waterproof curb covers are impregnated with a resin.

13. The shower stall of claim 8, wherein each curb cover is located over the underlying waterproof membrane.

14. The shower stall of claim 8, wherein each curb cover is located under the overlying waterproof membrane.

15. A method of waterproofing a shower stall, the shower stall having a shower stall floor bounded by a left wall, a right wall, a back wall and a curb that extends between the left and right walls to form a front side, the method comprising:

installing a shower pan over a shower stall floor;

installing a waterproof membrane over the shower pan and extending the membrane over the shower pan, partially up the left, right and back walls, and over the curb;

installing a first curb cover at an intersection between curb and the left wall; and installing a second curb cover at an intersection between curb and the right wall, the first and second curb covers each comprising a single piece of flexible sheet material having (1) a substantially vertically orientated, inverted u-shaped planar portion defining opposing substantially left and right vertical interior edges and defining a substantially horizontal interior top edge spanning between the ends of the vertical interior edges, (2) a left substantially vertical planar portion extending orthogonally outwardly from the u-shaped planar portion along the left vertical interior edge, (3) a right substantially vertical planar portion extending orthogonally outwardly from the u-shaped planar portion along the right vertical interior edge, and (4) a top substantially horizontal planar portion extending orthogonally outwardly from the u-shaped planar portion along the horizontal interior top edge, the top substantially horizontal planar portion orthogonally intersecting with the right substantially vertical planar portions at a right end and the top substantially horizontal planar portion orthogonally intersecting with the right substantially vertical planar portions at a left end.

16. The method of claim 15, further comprising installing flooring over the waterproof membrane.

17. The method of claim 15, wherein said installing the waterproof membrane further comprises:

applying a resin over the shower pan, the curb and up a portion of the surrounding walls;

laying a non-woven sheet material over the resin and pressing the material into the resin to fully wet and impregnate the non-woven sheet material with the resin;

curing the resin whereby upon cure the combination of the non-woven sheet material and the resin form the waterproof membrane.

18. The method of claim 17, wherein the first and second curb covers comprise a non-woven fabric material and wherein said installing in the first curb cover and installing the second curb cover each further comprise:

applying resin to surfaces proximate the intersection of the curb with the respective right or left wall;

laying the curb cover over the resin at the respective intersection and pressing the material into the resin to fully wet and impregnate the non-woven sheet material with the resin.

19. The method of claim 15, wherein said installing a waterproof membrane over the shower pan, partially up the left, right and back walls, and over the curb comprises bonding a waterproof flexible sheet material to the shower pan, partially up the left, right and back walls, and over the curb using an adhesive.

20. The method of claim 19, wherein the first and second curb covers are comprised of a flexible waterproof sheet material and wherein said installing in the first curb cover and installing the second curb cover each further comprise:

applying adhesive to a backside of the curb cover; and placing the curb cover over the respective intersection to secure it in place.

* * * * *